US008926372B2

(12) United States Patent
McSweyn

(10) Patent No.: US 8,926,372 B2
(45) Date of Patent: Jan. 6, 2015

(54) MULTIPLE PLUG SLIDING ADAPTER WITH FLEXIBLE EXTENSION

(71) Applicant: Scosche Industries, Inc., Oxnard, CA (US)

(72) Inventor: Christopher Michael McSweyn, Oxnard, CA (US)

(73) Assignee: Scosche Industries, Inc., Oxnard, CA (US)

( * ) Notice: Subject to any disclaimer, the term of this patent is extended or adjusted under 35 U.S.C. 154(b) by 81 days.

(21) Appl. No.: 13/841,452

(22) Filed: Mar. 15, 2013

(65) Prior Publication Data

US 2014/0273581 A1 Sep. 18, 2014

(51) Int. Cl.
*H01R 25/00* (2006.01)
*H01R 27/02* (2006.01)

(52) U.S. Cl.
CPC ..... *H01R 27/02* (2013.01)
USPC ..... 439/640

(58) Field of Classification Search
USPC ..... 439/640, 638, 502, 505
See application file for complete search history.

(56) References Cited

U.S. PATENT DOCUMENTS

| | | | | |
|---|---|---|---|---|
| 2,690,470 | A | 9/1954 | Moorhead | |
| 5,666,408 | A * | 9/1997 | Lao | 379/442 |
| 6,193,522 | B1 * | 2/2001 | Liao | 439/31 |
| 6,786,734 | B2 * | 9/2004 | Yu | 439/11 |
| 7,121,852 | B2 | 10/2006 | Ing et al. | |
| 7,473,141 | B2 | 1/2009 | Liao | |
| 7,556,535 | B2 * | 7/2009 | Liao | 439/640 |
| 7,815,471 | B2 * | 10/2010 | Wu | 439/640 |
| 7,901,250 | B2 * | 3/2011 | Lam et al. | 439/638 |
| 8,137,143 | B2 | 3/2012 | McSweyn et al. | |
| 8,157,574 | B2 * | 4/2012 | Hsiao | 439/131 |
| 8,298,003 | B2 | 10/2012 | Wu | |
| 2003/0157840 | A1 * | 8/2003 | Yanda | 439/638 |
| 2005/0009404 | A1 | 1/2005 | Lee | |
| 2008/0227338 | A1 * | 9/2008 | Lin et al. | 439/640 |
| 2012/0238120 | A1 | 9/2012 | Huang | |
| 2012/0238146 | A1 | 9/2012 | Liao | |

OTHER PUBLICATIONS

International Search Report and Written Opinion for corresponding Patent Cooperation Treaty Application PCT/US2014/021398; Jun. 25, 2014; 7 Pages.

* cited by examiner

*Primary Examiner* — Gary Paumen
(74) *Attorney, Agent, or Firm* — Stetina Brunda Garred & Brucker

(57) ABSTRACT

A multiple plug sliding adapter is disclosed. A first connector with a first terminal block is connected to an upstream cable. The first terminal block is also connected to a downstream first connector plug. A transform adapter is movably coupled to the first connector, and includes a first connector socket receptive to the first connector plug. An extension that spatially offsets the second connector from the transform adapter is connected to the first connector socket, and extends from the transform adapter. A second connector with a second terminal block is connected to the extension and a downstream second connector plug. The first connector plug and the second connector plug conform to different configuration standards.

17 Claims, 5 Drawing Sheets

MULTIPLE PLUG SLIDING ADAPTER WITH FLEXIBLE EXTENSION

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to electrical connectors for power and data interconnections of electronic devices, and more particularly, to a multiple plug sliding adapter with a flexible extension.

2. Related Art

A wide variety of portable electronic devices are currently in existence on the market, with each serving a particular need. For instance, there are electronic readers, music players, gaming consoles, cellular phones, personal digital assistants, digital still and video cameras, GPS/navigation devices, and so on. However, there has been an increasing trend towards the convergence of these divergent functions into a single device, the most typical being the smart phone, and to a lesser extent, slightly larger form factor devices such as tablets. Such devices incorporate general-purpose data processors for which software applications implementing the aforementioned functionalities can be written. Furthermore, these devices have ample memory space to store the applications and related data, as well as various wireless communications modalities such as WiFi and Bluetooth for data transfer convenience. Nevertheless, despite the prevalence and popularity of multi-function devices, the dedicated devices may be preferable to some in certain situations. Accordingly, it is typical for many to carry and use multiple portable electronic devices throughout daily life.

As with any electronic device, continuing functioning depends on the availability of a power source. In almost all cases, portable electronic devices include an on-board battery or at least the capacity to hold and draw power from the same. There are some devices such as those specific to in-vehicle use and an external DC power source is always available, and in which case, an on-board battery may not be necessary. When interior space in the device is not restricted, and the device does not draw much electrical power or is not intended for constant use, standard configuration disposable batteries such as AA, AAA, and the like may be used. However, many slim form factor devices require a uniquely configured battery that fits within the limited confines of the housing, and access thereto for replacement upon power depletion may be limited. Accordingly, such devices incorporate on-board charging circuits that are connectible to external adapters.

An electronic device can be connected to a power source in several different ways. One of the simplest modalities is an AC power adapter with a coaxial connector plug that is received within a corresponding socket on the device. Depending on the current carrying capacity, the size and shape of the plug and sockets may be varied. This variety and lack of standardization amongst manufacturers led to the proliferation of numerous proprietary, manufacturer-specific connectors and adapters that were not compatible with other devices with similar power requirements. Accordingly, there has been a drive towards standardizing power connections for portable electronic devices.

Many manufacturers now utilize the Universal Serial Bus (USB) connector to supply power to its devices, and in particular, the Micro-B plug. Of course, the USB connector is primarily a data transfer link and is therefore suitable for devices such as smart phones and music players that connect to general purpose computers to download data therefrom. Additionally, however, the USB standard defines one line for supply 5V DC power to interconnected devices, thereby eliminating the need for separate power adapters and connections. Despite the widespread adoption of USB/Micro-B connector plugs, some manufacturers have developed alternative connector plugs believed to be superior for application in their devices. These include the 30-pin dock connector and the Lighting connector both developed by Apple, Inc. of Cupertino, Calif.

Thus, many still face the difficulty and inconvenience associated with keeping multiple adapters and cables to power and charge different devices. There are devices known in the art for switching between one plug standard and another, where a conversion adapter with a socket for one standard and an output plug in another standard can be detached from a primary plug connected to the data/power source. With the output plug being integral with the conversion adapter, there are certain disadvantages appurtenant to the concentration of multiple failure points of each socket-plug interface along the chain of interconnections in a single structural unit. Accordingly, there is a need in the art for an improved multi-plug sliding adapter with a flexible extension.

BRIEF SUMMARY

An embodiment of the present disclosure contemplates a multiple plug adapter. The adapter may have a first connector with a first terminal block connected to an upstream cable. The first terminal block may also be connected to a downstream first connector plug. Additionally, the adapter may include a transform adapter that is movably coupled to the first connector. The transform adapter may include a first connector socket receptive to the first connector plug. There may also be an extension that is connected to the first connector socket, and can extend from the transform adapter. The adapter may further include a second connector with a second terminal block that may be connected to the extension and a downstream second connector plug. The first connector plug and the second connector plug may conform to different configuration standards. Furthermore, the extension may spatially offset the second connector from the transform adapter.

Another embodiment also contemplates a multiple plug adapter. There may be a first connector with a first connector housing that encloses a first terminal block. More particularly, the first terminal block can be connected to an upstream cable and a downstream first connector plug. There may also be a transform adapter that may include an adapter housing that is movably coupled to the first connector and encloses a first connector socket that is receptive to the first connector plug. The adapter may further include a flexible extension cable that is connected to the first connector socket and protrudes from the adapter housing. There may additionally be a second connector with a second connector housing that encloses a second terminal block that can be connected to the extension and a downstream second connector plug. The first connector plug and the second connector plug may conform to different configuration standards. The flexible extension cable is understood to spatially offset the second connector from the transform adapter.

In accordance with another embodiment, a device for selectively coupling an upstream connection to a one of a plurality of downstream connections is contemplated. The device includes a first connector with a first housing enclosing a first terminal block connected to the upstream connection. The first terminal block may also be connected to a first plug that is connectible to a first one of the plurality of downstream connections. The first housing may be defined by a pair of opposed longitudinal sidewalls each further defining a slide groove. The device may also include a rotatable adapter including an adapter housing that is defined by a body section and a pair of opposed connector arms extending from the body section. The adapter housing may enclose a first socket that is receptive to the first plug. Each of the connector arms may include cylindrical pivot axle engageable to a respective one of the slide grooves of the longitudinal sidewalls of the first housing. The device may also include an extension that is connected to the first socket and protrudes from the adapter housing. Furthermore, the device may include a second connector with a second housing that encloses a second terminal block. The extension connects to the second terminal block, as does a second plug connectible to a second one of the plurality of downstream connections.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of the presently preferred embodiment of a multiple plug adapter, and is not intended to represent the only form in which it can be developed or utilized. The description sets forth the functions for developing and operating the adapter in connection with the illustrated embodiments. It is to be understood, however, that the same or equivalent functions may be accomplished by different embodiments that are also intended to be encompassed within the scope of the present disclosure. It is further understood that the use of relational terms such as first, second, distal, proximal, and the like are used solely to distinguish one from another entity without necessarily requiring or implying any actual such relationship or order between such entities.

Figure 1:
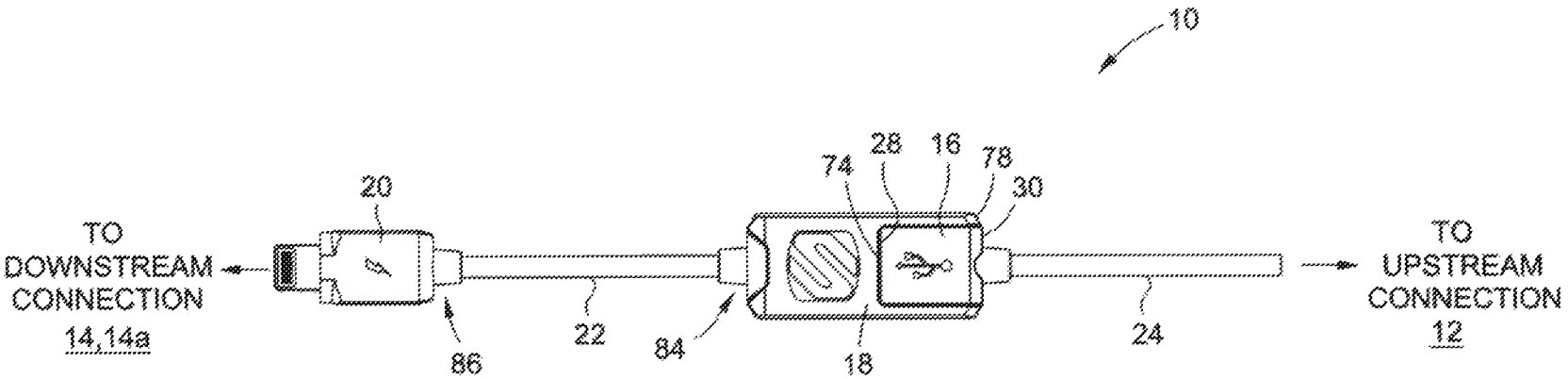
FIG. 1 is a top view of a multiple plug sliding adapter in accordance with one embodiment of the present disclosure.

FIG. 1 depicts one embodiment of a multiple plug adapter 10 that couples an upstream connection 12 and a downstream connection 14 as contemplated by the present disclosure. As will be discussed in further detail below, there may be more than downstream connection 14, so the one shown in FIG. 1 may also be referenced more particularly as a first downstream connection 14*a*. In several of the embodiments, the connections of the multiple plug adapter 10 conforms to the Universal Serial Bus (USB) standard, and includes attendant data+, data−, identifier, power (VCC) and ground lines and connectors therefor. In this regard, the upstream connection 12 may be to a USB host device, while the downstream connection 14 is to a peripheral device such as a smart phone, music player, or the like. There may be some cases where no data is transmitted to or from the upstream connection 12, and only electrical power for charging or operating the peripheral device is provided. The upstream connection 12 for such implementations may also be to a USB host device or to a dedicated AC adapter or other like power source. While the various features of the present disclosure are explained in terms of USB connections, those having ordinary skill in the art will recognize that such features are just as applicable to other types of connections for electrical power and data transmission.

The multiple plug adapter 10 is generally comprised of a first connector 16, a transform adapter 18, and a second connector 20 that is connected to the transform adapter 18 with an extension 22. The first connector 16 can be electrically connected to either the transform adapter 18 or to another peripheral device that has a corresponding socket receptive thereto. When the first connector 16 is electrically connected to the transform adapter 18, it is also electrically connected to the second connector 20 by way of the extension 22. The upstream connection 12 and the first downstream connection 14*a* are therefore linked.

Figure 2:
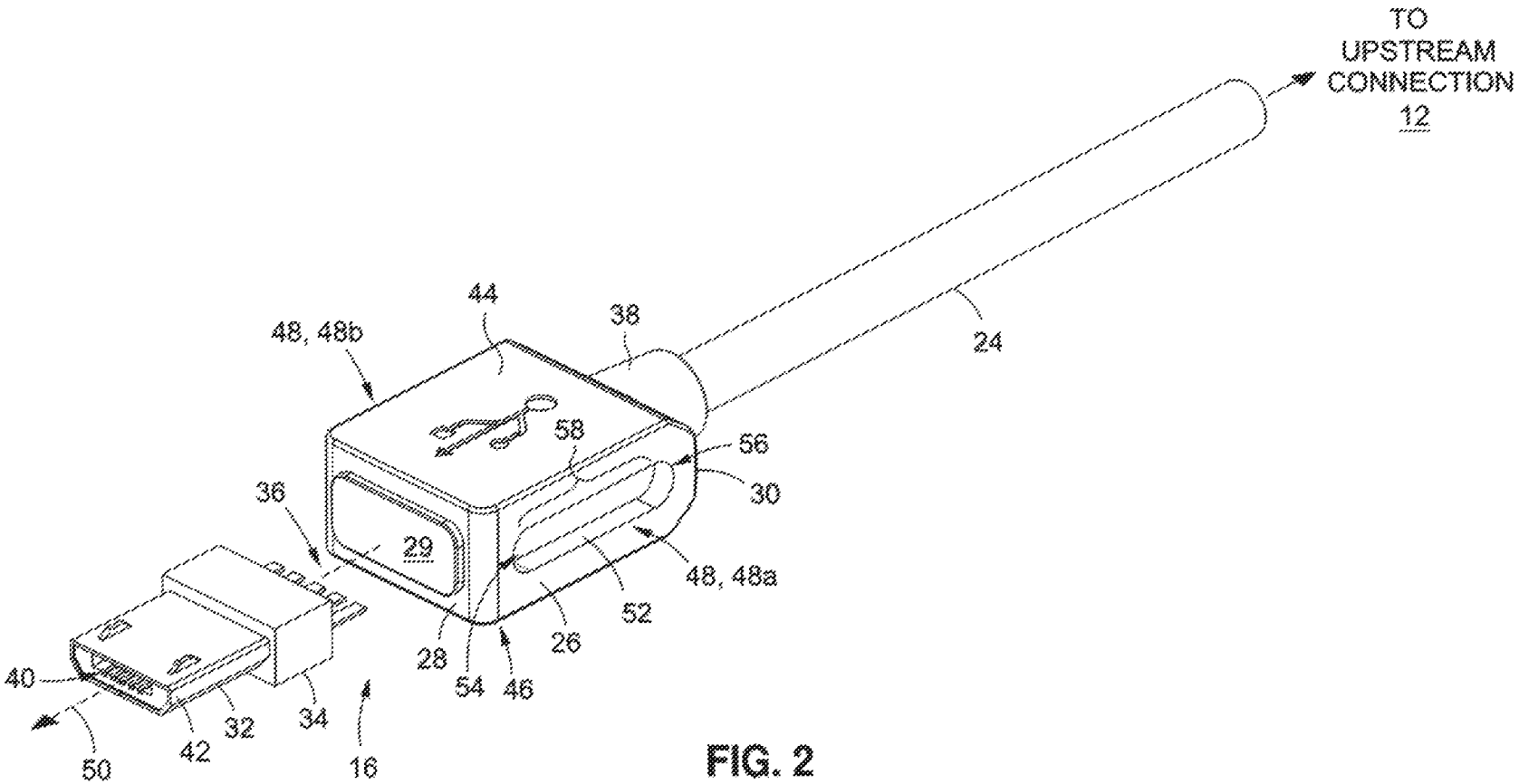
FIG. 2 is an exploded perspective view of one embodiment of a first connector of the multiple plug sliding adapter showing a first plug, a first terminal block, and a first connector housing.

With additional reference to FIG. 2, the first connector 16 is attached to an upstream cable 24 for the upstream connection 12. According to one embodiment, the first connector 16 includes a connector housing 26 defined by a top end 28 and an opposed bottom end 30 to which the upstream cable 24 is attached. Disposed on the top end 28 is a first connector plug 32 that can be either attached to or integral with a first terminal block 34. As will be recognized by those having ordinary skill in the art, the upstream cable 24 includes a plurality of signal wires corresponding to the various USB signal lines mentioned above. Outside the connector housing 26, these individual signal wires are bundled within the upstream cable 24, but they are separated for individual connection to terminal prongs 36 inside the connector housing 26. For resiliency in axial (pulling) forces and lateral (bending) forces that are typically applied to the upstream cable 24, the entire front portion of the upstream cable 24 is fixed to the connector housing 26. More particularly, there may be a flexible grommet 38 attached to the connector housing 26, through which the upstream cable 24 is inserted and fixed.

The terminal prongs 36 are part of the first terminal block 34, and there may be conductive traces therefrom to the individual contacts 40 exposed on the first connector plug 32. The contacts 40 are understood to be disposed within a plug body 42. The first terminal block 34 is mounted in the connector housing 26, such that the first connector plug 32 protrudes from an opening 29 defined by the top end 28 of the connector housing 26. In accordance with one embodiment of the present disclosure, the size and shape configuration of the plug body 42, as well as the layout and arrangement of the contacts 40 within, are understood to conform to the USB Micro-B. This is by way of example only however, and any other suitable connection or plug standard such as USB Micro-A, USB Mini-A, and the like may be substituted without departing from the scope of the present disclosure.

While the first connector plug 32 is standardized, the connector housing 26 need not be, and generally conforms to the shape of the transform adapter 18 as will be described more fully below. It is further defined by a front face 44 and an opposed rear face 46, as well as a pair of longitudinal sidewalls 48, including a left sidewall 48*a* and a right sidewall 48*b*, so referenced because of its parallel relationship to a longitudinal insertion axis 50 of the first connector 16.

The sidewalls 48 each define an outward facing slide groove 52 characterized by a proximal end 54 and an opposed distal end 56 with an elongate portion 58 between.

The size and shape features of the first connector 16 and its subparts largely depend on the transform adapter 18, and vice versa. According to various embodiments of the present disclosure, the first connector 16 is movably coupled to the transform adapter 18. In some instances, the transform adapter 18 may be referred to as being movably coupled to the first connector 16, but in either case, the movable engagement between these two components is what is being expressed.

Figure 3A:
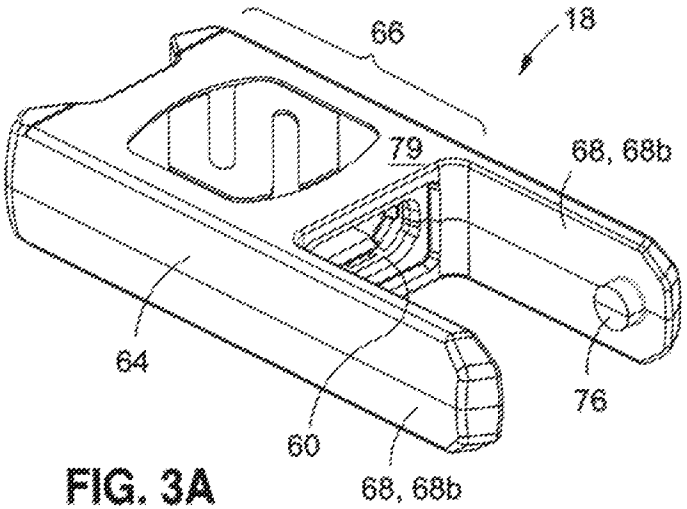
FIG. 3A is a rear perspective view of a transform adapter of the contemplated multiple plug sliding adapter.
Figure 4:
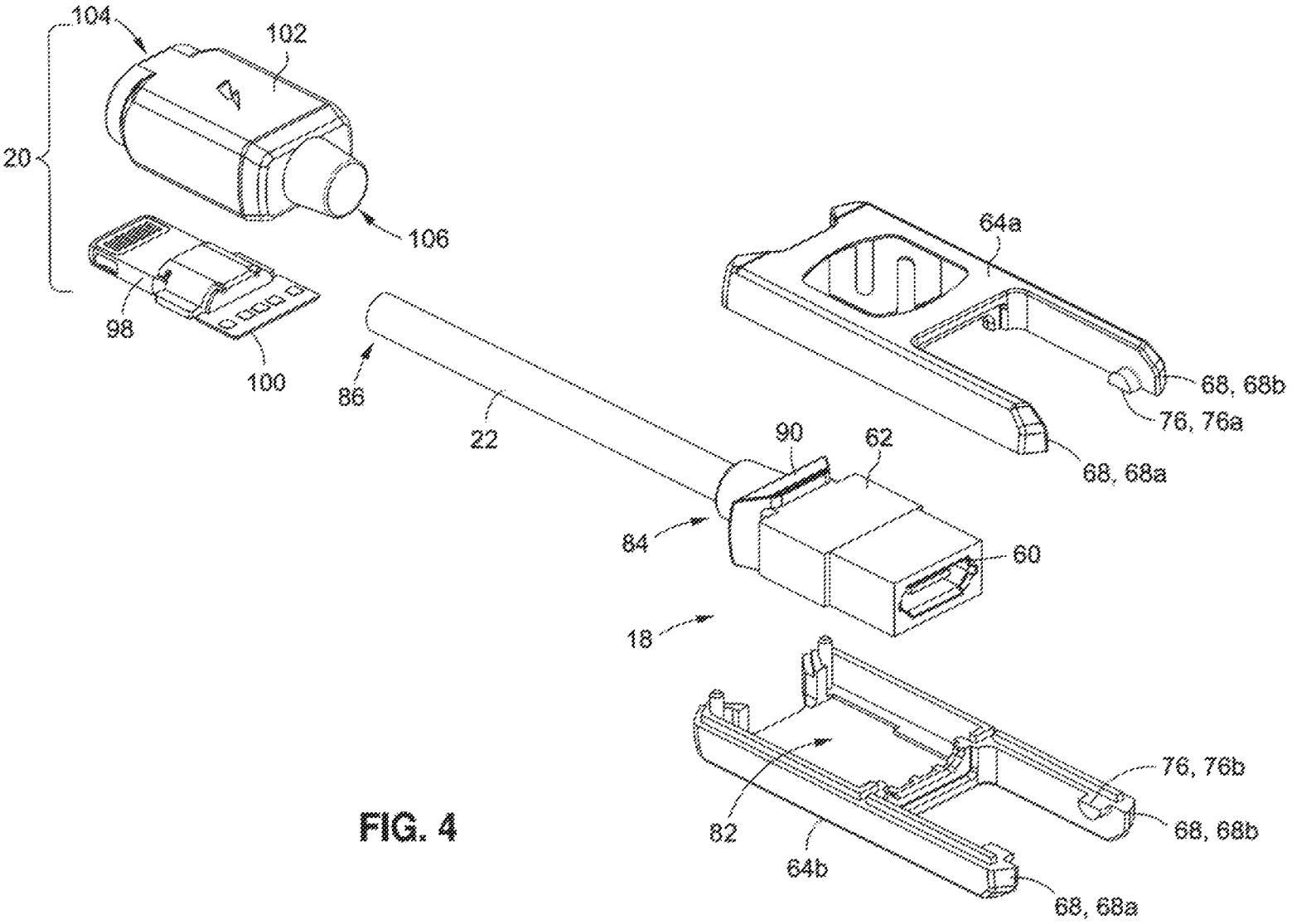
FIG. 4 is an exploded perspective view showing various constituent parts of the multiple plug sliding adapter of the present disclosure.

In general, the transform adapter 18 is understood to be the modality by which the first connector 16 can be used to selectively make one of two downstream connections 14 with the upstream connection 12. To this end, as shown in FIG. 3A and FIG. 4, the transform adapter 18 includes a first connector socket 60 that is receptive to the aforementioned first connector plug 32. In this regard, the first connector socket 60 is understood to similarly conform to the USB Micro-B standard for sockets that receive this plug, i.e., the USB Micro-B first connector plug 32. Each of the contacts in the first connector socket 60 may be individually connected to a socket terminal block 62.

The first connector socket 60 and the socket terminal block 62 are enclosed within and mounted to an adapter housing 64. As best shown in the exploded perspective view of FIG. 4, in one example implementation, the adapter housing 64 may be defined by an upper housing shell 64*a* and a lower housing shell 64*b*. The two halves of the shell 64*a*, 64*b* are understood to be substantially the same, and together define the various features of the adapter housing 64 as will be described more fully below. With reference to FIG. 3A and FIG. 3B, the adapter housing 64 is also defined by a body section 66 that encloses the aforementioned first connector socket 60 and the socket terminal block 62. Additionally, the adapter housing 64 may be defined by a pair of opposed connector arms 68 that extends longitudinally from the body section 66. Described alternatively, the adapter housing 64 may define a first connector reception slot 70, which, as suggested by its name, receives the first connector 16. The first connector reception slot 70 may be defined by inward facing longitudinal walls 72, as well as by a lateral wall 74, which defines an opening for the first connector socket 60. In further detail, there is a left inward facing longitudinal wall 72*a* and an opposed right inward facing longitudinal wall 72*b*.

However defined, a distal end 75 includes cylindrical pivot axles 76. The left inward facing longitudinal wall 72*a*. i.e., the left connector arm 68*a*, includes a left pivot axle 76*a*, while the right inward facing longitudinal wall, 72*b*, i.e., the right connector arm 68*b*, includes a right pivot axle 76*b*. The two pivot axles 76 are understood to be in axial alignment and extend inwardly towards each other, with both protruding from the respective inward facing longitudinal walls 72.

As indicated above, various embodiments of the present disclosure contemplate the movable, sliding and rotating engagement of the first connector 16 to the transform adapter 18. In this regard, the pivot axles 76 are understood to be engageable to the respective slide grooves 52 of the correspondingly opposing sidewall 48. The diameter of the pivot axles 76 are thus understood to be sized for a slight friction fit against the width of the slide grooves 52. Along these lines, the height of the pivot axles 76 is understood to be sized for a similar slight friction fit/sliding engagement and thus have an appropriate depth.

Aside from the engagement of the pivot axles 76 and the slide grooves 52, the first connector 16 is understood to fit within the first connector reception slot 70. The lateral wall 74 corresponds to a width of the connector housing 26, and the length of the connector housing 26, i.e., the length along the sidewall 48 between the top end 28 and the bottom end 30, is substantially the same as the length from the lateral wall 74 to a distal end 78 of the adapter housing 64. In particular, with the first connector plug 32 fully inserted into the first connector socket 60 as shown in FIG. 1, the distal end 78 of the adapter housing 64 is flush with the bottom end 30 of the connector housing 26, and the lateral wall 74 of the adapter housing 64 is flush with the top end 28 of the connector housing 26. In this position, the pivot axles 76 are understood to abut against the distal end 56 of the slide groove 52, or at least substantially toward the same. This represents a minimum retraction position of the connector housing 26 relative to the adapter housing 64.

Figure 5B:
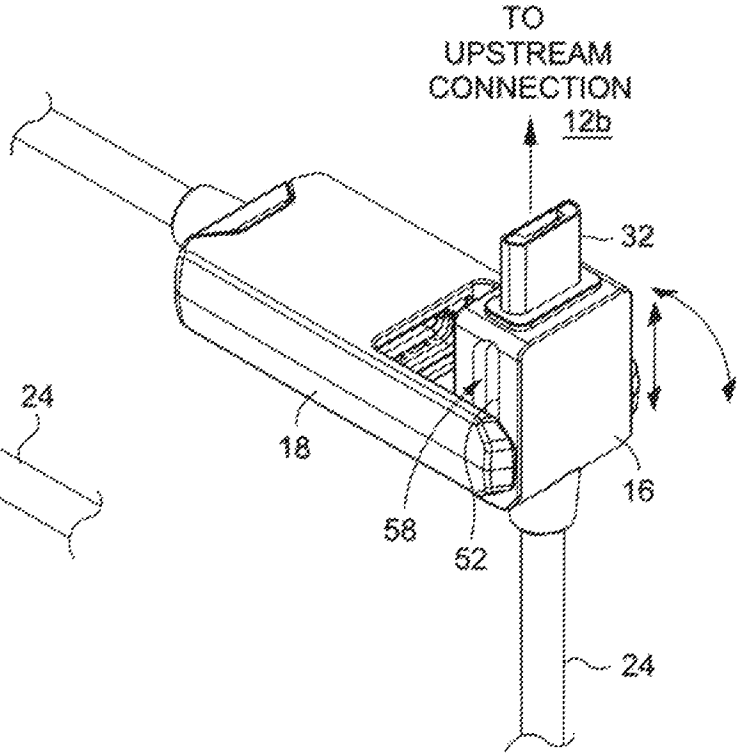
FIG. 5B is a perspective view of the first connector rotated relative to the transfer adapter.
Figure 5A:
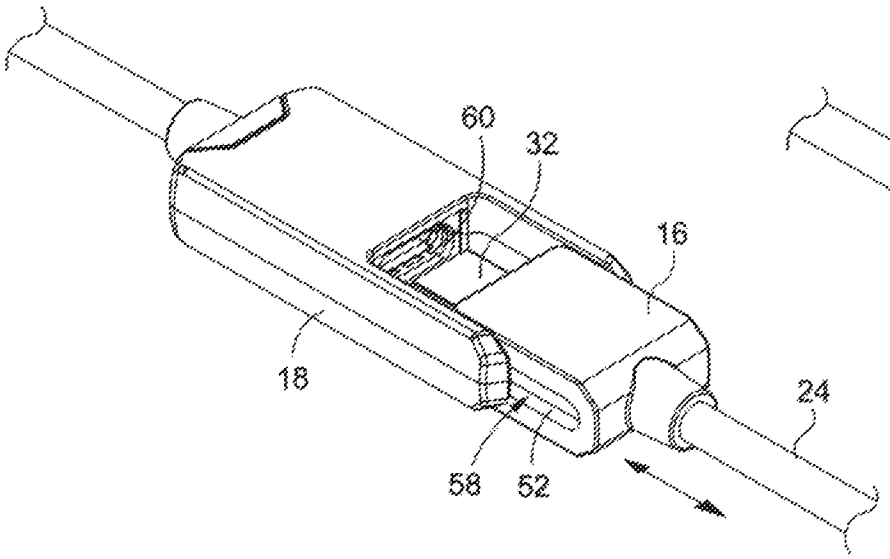
FIG. 5A is a perspective view of the first connector being in a maximum extension position in which the first plug of the first connector is disengaged from a socket of the transfer adapter.

Referring now to FIG. 5A, the first connector 16 can be extended from the transform adapter 18. As the first connector plug 32 is being withdrawn from the first connector socket 60, the pivot axles 76 slide along the elongate portion 58 of the slide grooves 52. Upon the first connector plug 32 clearing the first connector socket 60, the first connector 16 is freely rotatable, in part due to the circular configuration of the pivot axles 76. The first connector 16 can be fully extended such that the pivot axles 76 are in abutment against the proximal end 54 of the slide grooves 52. Both the proximal ends 54 and the distal ends 56 of the slide grooves 52 have a rounded corresponding to the circular configuration of the pivot axles 76 so that the first connector 16 remains rotatable despite being fully extended. The first connector 16 need not be extended to this position, however, before it can be rotated.

FIG. 5B shows the first connector plug 32 disengaged from the first connector socket 60, with the first connector 16 being rotated 90 degrees relative to the transform adapter 18. The first connector plug 32 is thus free to be connected to a second downstream connection 14*b*. The first connector 16 is still in sliding engagement with the transform adapter 18, as the pivot axles 76 remains within the slide grooves 52.

The pivot axles 76 are understood to be centrally disposed relative to the thickness defined by the adapter housing 64. In the embodiments in which the adapter housing 64 is comprised of the upper and lower shells 64*a*, 64*b*, the pivot axles 76 are also characterized by an upper half cylinder 76*a* and a lower half cylinder 76*b*. The connector housing 26 and the adapter housing 64 are understood to have the same thickness, and so the front face 44 of the connector housing 26 is understood to be coplanar with a front face 79 of the adapter housing 64. As such, the slide groove 52 is also understood to be centrally defined relative to the thickness of the connector housing 26, i.e., the width of the sidewall 48.

Although one embodiment of a first connector 16 that is movably engaged to the transform adapter 18 has been illustrated, this has been by way of example only and not of limitation. Any other suitable modality by which the first connector 16 is movably engaged to the transform adapter 18 may be substituted without departing from the scope of the present disclosure.

As indicated above, the first connector socket 60 and the socket terminal block 62 are enclosed within the adapter housing 64. To this end, the adapter housing 64, and the respective upper and lower shells 64*a*, 64*b* thereof, define shaped receptacles 82 therefor. The two shells 64*a*, 64*b* may thus sandwich the first connector socket 60 and the socket terminal block 62, and be frictionally engaged to each other. Those having ordinary skill in the art will recognize the variety of possible configurations that simplifies manufacturing of the adapter housing 64.

Referring again to FIG. 1, various embodiments of the present disclosure incorporate the extension 22 that is attached to the transform adapter 18. As shown in the exploded perspective view of FIG. 4, the extension 22 is connected to the first connector socket 60 indirectly, by way of the socket terminal block 62. Like the upstream cable 24, the extension 22 is understood to include a plurality of signal lines that correspond to the contacts on the first connector socket 60. The extension 22 is defined by a proximal end 84 that is attached to the transform adapter 18, and a distal end 86 that is attached to the second connector 20.

Figure 3C:
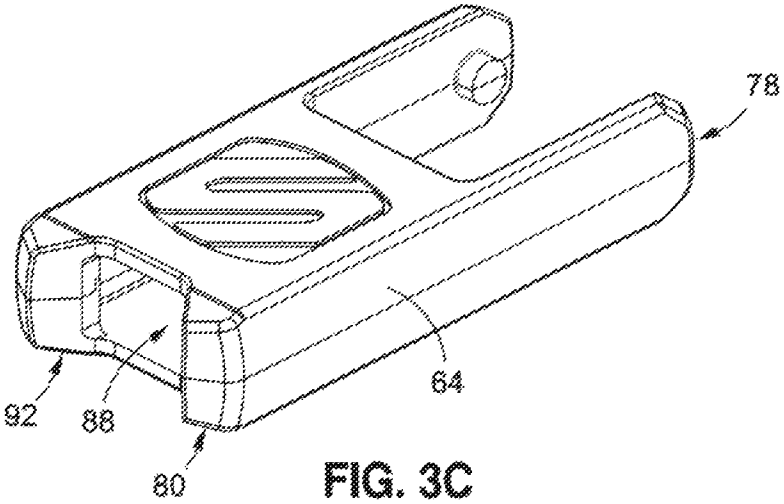
FIG. 3C is a front perspective view of the transfer adapter shown in FIGS. 3A and 3B.
Figure 3B:
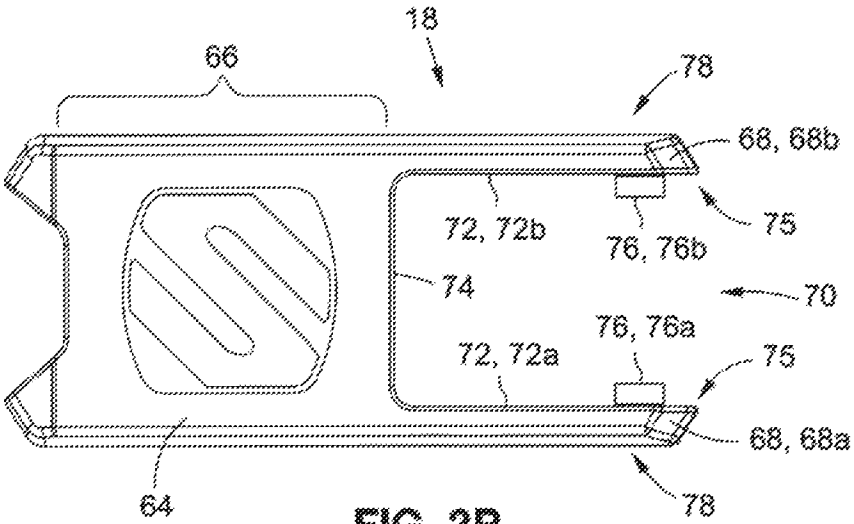
FIG. 3B is a top plan view of the transfer adapter shown in FIG. 3A.

As shown in FIG. 3C, the transform adapter 18, and specifically the adapter housing 64 thereof, is defined by the aforementioned distal end 78, as well as a proximal end 80. In accordance with various embodiments, the extension 22 protrudes from an opening 88 on the proximal end 80. The extension 22 may be a flexible cable that carries individual signal lines. To further isolate the cable from mechanical stresses that may be imparted thereon, there is a grommet 90 that conforms in shape to a corresponding notch 92 defined by the proximal end 80 of the adapter housing 64.

In accordance with one embodiment, the second connector 20 may conform to a proprietary specification called Lightning, from Apple, Inc. Other connector specifications may be implemented, such as the 30-pin dock connector also from Apple, Inc., or any other suitable specification that is, in any case, different from that of the first connector 16. Despite having different mechanical specifications, the signals transmitted via the first connector 16 and the second connector 20, including electrical power levels, are understood to be the same and conform to the same USB host/peripheral standard. Again, the second connector 20) may be received in a corresponding socket of the first downstream connection 14*a*. The second connector 20 is understood to have a second connector plug 98, also referred to as a downstream plug, which is fixed to a second connector terminal block 100, to which the individual signal lines in the extension 22 terminate. The second connector terminal block 100 is enclosed within a connector housing 102. The second connector plug 98 protrudes from a distal end 104 of the connector housing 102, while the extension 22 attaches to an opposed proximal end 106 of the same.

The extension 22 is understood to spatially offset the second connector 20 from the transform adapter 18. Especially with connectors that are designed to be frequently removed and attached as is the case for electrical chargers, the possibility of damage is high. The movable engagement mechanism can represent a structural weakness, particularly in relation to a solid, non-movable connector or adapter. The spatial offset of the second connector 20 is thus envisioned to shift commonly encountered forces to a different part of the multiple plug adapter 10.

The particulars shown herein are by way of example and for purposes of illustrative discussion of the embodiments of the present invention only and are presented in the cause of providing what is believed to be the most useful and readily understood description of the principles and conceptual aspects of the adapter. In this regard, no attempt is made to show more details than is necessary for a fundamental understanding of the disclosure, the description taken with the drawings making apparent to those skilled in the art how the several forms of the presently disclosed adapter may be embodied in practice.

What is claimed is:

1. A multiple plug adapter, comprising:

a first connector with a first connector housing enclosing a first terminal block connected to an upstream cable and a downstream first connector plug;

a transform adapter including an adapter housing movably coupled to the first connector and enclosing a first connector socket receptive to the first connector plug;

a flexible extension cable connected to the first connector socket and protruding from the adapter housing; and a second connector with a second connector housing enclosing a second terminal block connected to the extension and a downstream second connector plug;

wherein the first connector plug and the second connector plug conform to different configuration standards, and the flexible extension cable spatially offsets the second connector from the transform adapter.

2. The adapter of claim 1, wherein the transform adapter includes a socket terminal block connected to the first connector socket and to the flexible extension cable, the socket terminal block being enclosed within the adapter housing.

3. The adapter of claim 2, wherein the adapter housing defines an opening through which the flexible extension cable extends.

4. The adapter of claim 3, further comprising:

a flexible grommet disposed in the opening of the adapter housing and surrounding a segment of the flexible extension cable.

5. The adapter of claim 1, wherein the adapter housing includes an upper housing shell and a lower housing shell.

6. The adapter of claim 1, wherein:

the first connector housing defines a pair of outward facing longitudinal slide grooves; and the adapter housing defines a first connector reception slot, inward facing longitudinal walls of the adapter housing defining the first connector reception slot each including pivot axles received in sliding engagement with the slide grooves of the first connector housing.

7. The adapter of claim 6, wherein the pair of outward facing longitudinal slide grooves are each defined by a proximal end and an opposed distal end, the proximal end corresponding to a maximum extension position of the first connector housing relative to the adapter housing.

8. The adapter of claim 7, wherein the distal end corresponds to a minimum retraction position of the first connector housing relative to the adapter housing.

9. The adapter of claim 7, wherein the first connector housing is in rotatable engagement with the adapter housing.

10. The adapter of claim 9, wherein the proximal and distal ends of the outward facing longitudinal slide grooves are circular in correspondence to circularly defined pivot axles.

11. The adapter of claim 1, wherein the first connector plug is a USB Micro-B standard plug.

12. A device for selectively coupling an upstream connection to a one of a plurality of downstream connections, the device comprising:

a first connector with a first housing enclosing a first terminal block connected to the upstream connection and a first plug connectible to a first one of the plurality of downstream connections, the first housing being defined by a pair of opposed longitudinal sidewalls each further defining a slide groove;

a rotatable adapter including an adapter housing defined by a body section enclosing a first socket receptive to the first plug and a pair of opposed connector arms extending from the body section with each of the connector arms including a cylindrical pivot axle engageable to a respective one of the slide grooves of the longitudinal sidewalls of the first housing;

an extension connected to the first socket and protruding from the adapter housing; and a second connector with a second housing enclosing a second terminal block connected to the extension and a second plug connectible to a second one of the plurality of downstream connections; wherein the extension is a flexible cable.

13. The device of claim 12, the extension spatially offsets the second connector from the adapter.

14. The device of claim 12, wherein the slide grooves are each defined by a proximal end and an opposed distal end, the distal end corresponding to a maximum extension position of the first connector relative to the adapter housing.

15. The device of claim 14, wherein the proximal ends of the slide grooves correspond to a minimum retraction position of the first connector housing relative to the adapter housing.

16. The device of claim 12, wherein the first plug and the second plug conform to different configuration standards.

17. The device of claim 12, wherein the first plug is a USB Micro-B standard plug.

* * * * *